US009253567B2

(12) United States Patent
Morcelli et al.

(10) Patent No.: US 9,253,567 B2
(45) Date of Patent: Feb. 2, 2016

(54) ARRAY MICROPHONE APPARATUS FOR GENERATING A BEAM FORMING SIGNAL AND BEAM FORMING METHOD THEREOF

(75) Inventors: Alessandro Morcelli, Montello (IT); Marco Veneri, Milan (IT)

(73) Assignee: STMICROELECTRONICS S.R.L., Agrate Brianza (IT)

( * ) Notice: Subject to any disclaimer, the term of this patent is extended or adjusted under 35 U.S.C. 154(b) by 616 days.

(21) Appl. No.: 13/601,225

(22) Filed: Aug. 31, 2012

(65) Prior Publication Data

US 2013/0051577 A1 Feb. 28, 2013

(30) Foreign Application Priority Data

Aug. 31, 2011 (IT) ..... MI2011A1561

(51) Int. Cl.
*H04R 3/00* (2006.01)

(52) U.S. Cl.
CPC ..... *H04R 3/005* (2013.01); *H04R 2201/403* (2013.01); *H04R 2430/25* (2013.01)

(58) Field of Classification Search
CPC ..... H04R 3/005; H04R 2430/25; H04R 2201/403
USPC ..... 381/92, 119; 700/94
See application file for complete search history.

(56) References Cited

U.S. PATENT DOCUMENTS 5,793,875 A * 8/1998 Lehr et al. ..... 381/313
7,471,798 B2 12/2008 Warren
7,706,579 B2 4/2010 Zhang et al.
8,638,951 B2 * 1/2014 Zurek ..... H04R 3/005 348/231.4
8,649,529 B2 * 2/2014 Klefenz et al. ..... 381/92
2002/0131580 A1 9/2002 Smith
2003/0142836 A1 7/2003 Warren et al.

(Continued)

OTHER PUBLICATIONS

Hoshuyama et al., "A Robust Generalized Sidelobe Canceller with a Blocking Matrix Using Leaky Adaptive Filters," *Electronicsand Communications in Japan Part 3*, 80(8): 1516-1524, Sep. 9, 1996.

(Continued)

*Primary Examiner* — Fan Tsang
*Assistant Examiner* — Eugene Zhao
(74) *Attorney, Agent, or Firm* — Seed IP Law Group PLLC

(57) ABSTRACT

Embodiments described in the present disclosure relate to an array microphone apparatus for generating a beam forming signal. The apparatus includes first, second, and third omni-directional microphones, each converting an audible signal into a corresponding electrical signal. The three microphones are arranged in a horizontal coplanar alignment, and the second microphone is disposed between the other two microphones. The apparatus includes a first directional microphone forming device to jointly output a first directional microphone signal with a first bi-directional pattern, and a magnitude and phase response handler device to output a second directional microphone signal with an omni-directional pattern shifted by a prefixed value with respect to first directional microphone signal. The apparatus further includes a combining device receiving the first and second directional microphone signals and outputting a combined directional microphone signal with a combined beam pattern correlated to the first bi-directional and second omni-directional patterns, the combined directional microphone signal being perpendicular to the horizontal coplanar alignment of the first, second, and third omn-directional microphones.

10 Claims, 8 Drawing Sheets

(56) References Cited

U.S. PATENT DOCUMENTS

2003/0147539 A1* 8/2003 Elko et al. ..... 381/92
2012/0013768 A1* 1/2012 Zurek et al. ..... 348/231.4

OTHER PUBLICATIONS

Extended European Search Report, dated Feb. 24, 2012, for Italian Application No. MI20111561, 10 pages.

* cited by examiner

ARRAY MICROPHONE APPARATUS FOR GENERATING A BEAM FORMING SIGNAL AND BEAM FORMING METHOD THEREOF

BACKGROUND

1. Technical Field

The present disclosure relates to an array microphone apparatus and in particular to an array microphone apparatus for generating a beam forming signal and a beam forming method thereof.

2. Description of the Related Art

For ease of understanding, the following is a glossary of certain terms used herein:

First order difference pattern: a pattern that is formed as the difference in pressure between two points in space. The two-port microphones often used in hearing aids are of this type.

Cardioid: a first order difference pattern that has maximum response in the forward direction and a single null to the rear.

Bidirectional: general name for any pattern that has equal maximum response in both the front and rear directions.

Many communication system and voice recognition devices are designed for use in noisy environments. Examples of such applications include communication and/or voice recognition in cars or mobile environments (e.g., on street), conference calls, Flat panel TV's, Laptop or other computers, camera modules, Smartphones, and the like.

For these applications, the microphones in the system may pick up both the desired voice and also noise. The noise can degrade the quality of voice communication and speech recognition performance if it is not dealt with in an effective manner able to improve communication quality and voice recognition performance.

Noise suppression may be achieved using various techniques. One of these techniques, known in the state of the art, is the so called array microphone technique.

With reference to this technique, it is to be noted, as known to a skilled man, that a substantial directivity can only be obtained with a spatial distribution larger than the minimum relevant wavelength.

In the array microphone technique it is possible to distinguish two meaningful groups of linear arrays characterized by the position of the microphones and the main source angles:

End Fire beam forming, and

Broad Side beam forming.

It is defined broadside beam forming in the array depicted in FIG. 1 where the microphones M1, . . . , Mn are placed along the x-axis, and the main beam is perpendicular (y-axis) to the line of microphones. Particularly the sound coming from a 90° direction is kept, and the sound coming from the 0° direction is deleted.

It is defined end fire beam forming in the array depicted in FIG. 2 where the microphones M1, . . . , Mn are placed along the y-axis and the main beam is in the direction of the microphones, i.e., the x-axis. Particularly the sound coming from a 0° direction is kept, and the sound coming from the 90° direction is deleted.

It is to be noted also that, the end fire technique is simpler with respect to the broad side beam forming. However the end fire technique has few applications since deleting front signal sources is generally not suitable for Laptop or Flat panel TV modules.

On the other side the broad side beam forming technique is the solution most implemented since it provides noise suppression, wind noise suppression (mobile phones makers), and speech enhancement sound equalization.

However, the broad side beam forming technique is generally realized with a complex algorithm performing Fast Fourier Transform (FFT), adaptive suppression, and also inverse FFT.

Therefore, the broad side beam forming technique often uses a powerful digital signal processor (DSP) or microcontroller, software development memory, and several million instructions per second (MIPS) allocation for the algorithm.

Further it is to be noted that the simplest broad side beam forming technique works by taking advantages from the placement of the microphones or by using delays, but this technique works properly only for a fixed frequency.

These techniques appear to be very capable but are not always cost-effective and flexible to use in practical situations.

Thus effective suppression of noise in communication system and voice recognition devices is desirable using a cost effective apparatus.

BRIEF SUMMARY

An object of the present invention is to provide an apparatus for generating a beam forming signal and a beam forming method thereof.

With embodiments described herein, it is possible to obtain an apparatus able to reduce the sound coming, for example, from the directions beside the array microphone ($\theta=0°$ and $\theta=180°$) and conversely able to keep the sound coming, for example, from the front of the array microphone ($\theta=90°$ and $\theta=270°$).

Moreover, with embodiments described herein, it is possible to convert an omni-directional microphones array into a bidirectional pattern.

Further according to an embodiment, the apparatus is implemented with a full digital device therefore avoiding the use of complex algorithm, or additional memories or MIPS.

Finally, the apparatus according to the present invention, works properly for all the bandwidth.

BRIEF DESCRIPTION OF THE SEVERAL VIEWS OF THE DRAWINGS

Characteristics and advantages will appear from the following detailed description of a practical embodiment, illustrated as a non-limiting example in the set of drawings. Non-limiting and non-exhaustive embodiments are described with reference to the following drawings, wherein like labels refer to like parts throughout the various views unless otherwise specified. The sizes and relative positions of elements in the drawings are not necessarily drawn to scale. For example, some of these elements are enlarged and positioned to improve drawing legibility. One or more embodiments are described hereinafter with reference to the accompanying drawings in which.

DETAILED DESCRIPTION

Although this is not expressly shown, the individual features described with reference to each embodiment shall be intended as auxiliary and/or interchangeable with other features, as described with reference to other embodiments.

Figure 1:
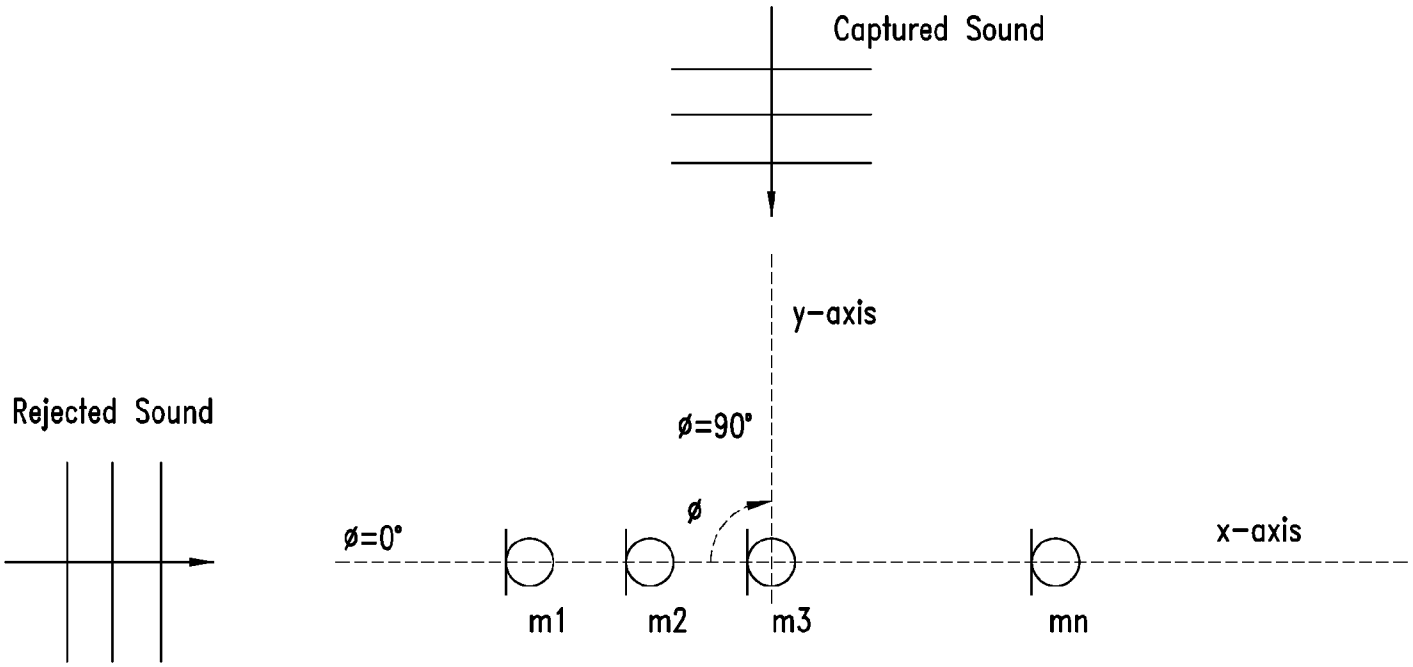
FIG. 1 (Prior Art)
FIG. 1 shows a general array of microphones in a broadside configuration.
Figure 2:
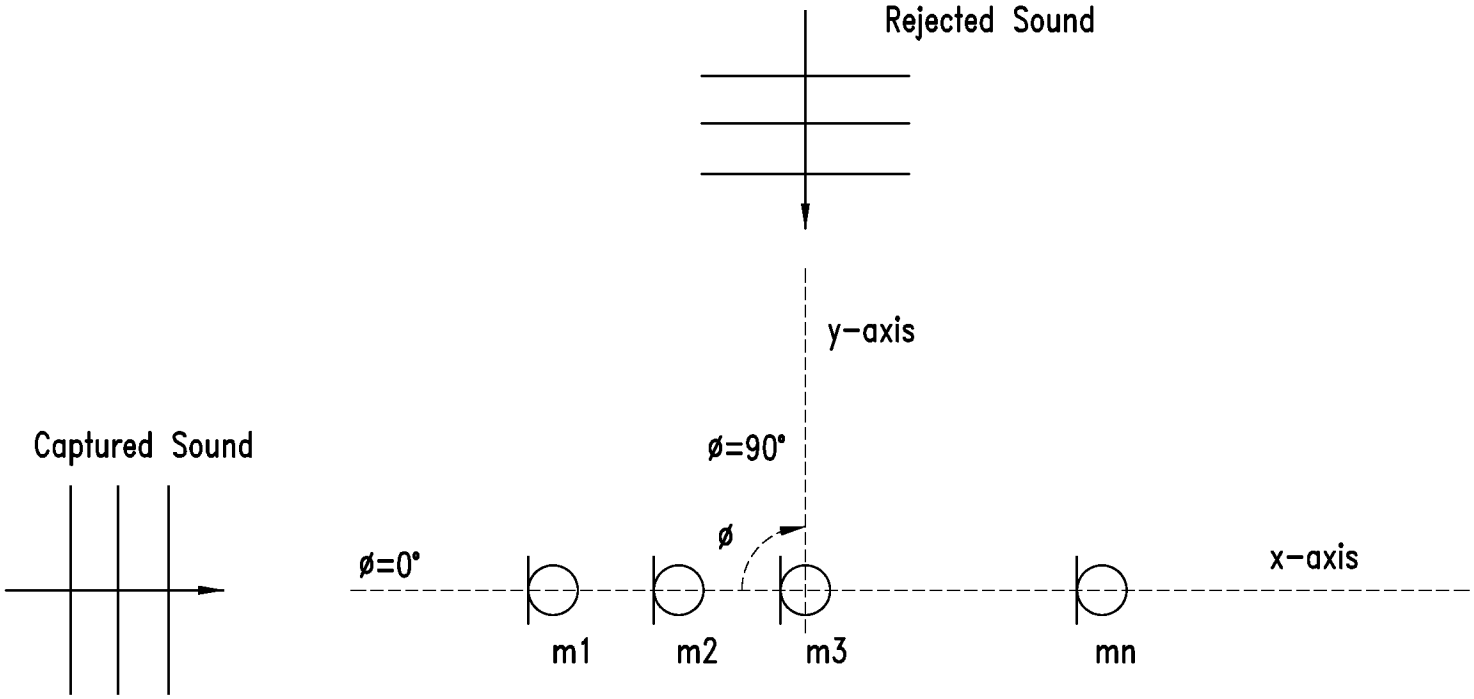
FIG. 2 (Prior Art)
FIG. 2 shows a general array of microphones in an end fire configuration.

With reference to FIG. 1, it is indicated with an array microphone apparatus 1 for generating a beam forming signal according to an embodiment.

The apparatus 1 includes:

at least a first, a second and a third omni-directional microphone, m1, m2 and m3, respectively, a first directional microphone forming device 2, a magnitude and phase response handler device 3, and a combining device 4.

Each of the omni-directional microphones m1, m2 and m3 are suitable for converting an audible signal into a corresponding first, second and third electrical signal s1, s2 and s3.

According to an embodiment, one of the omni-directional microphone m1, m2 and m3 is disposed between the other two omni-directional microphones.

Figure 3:
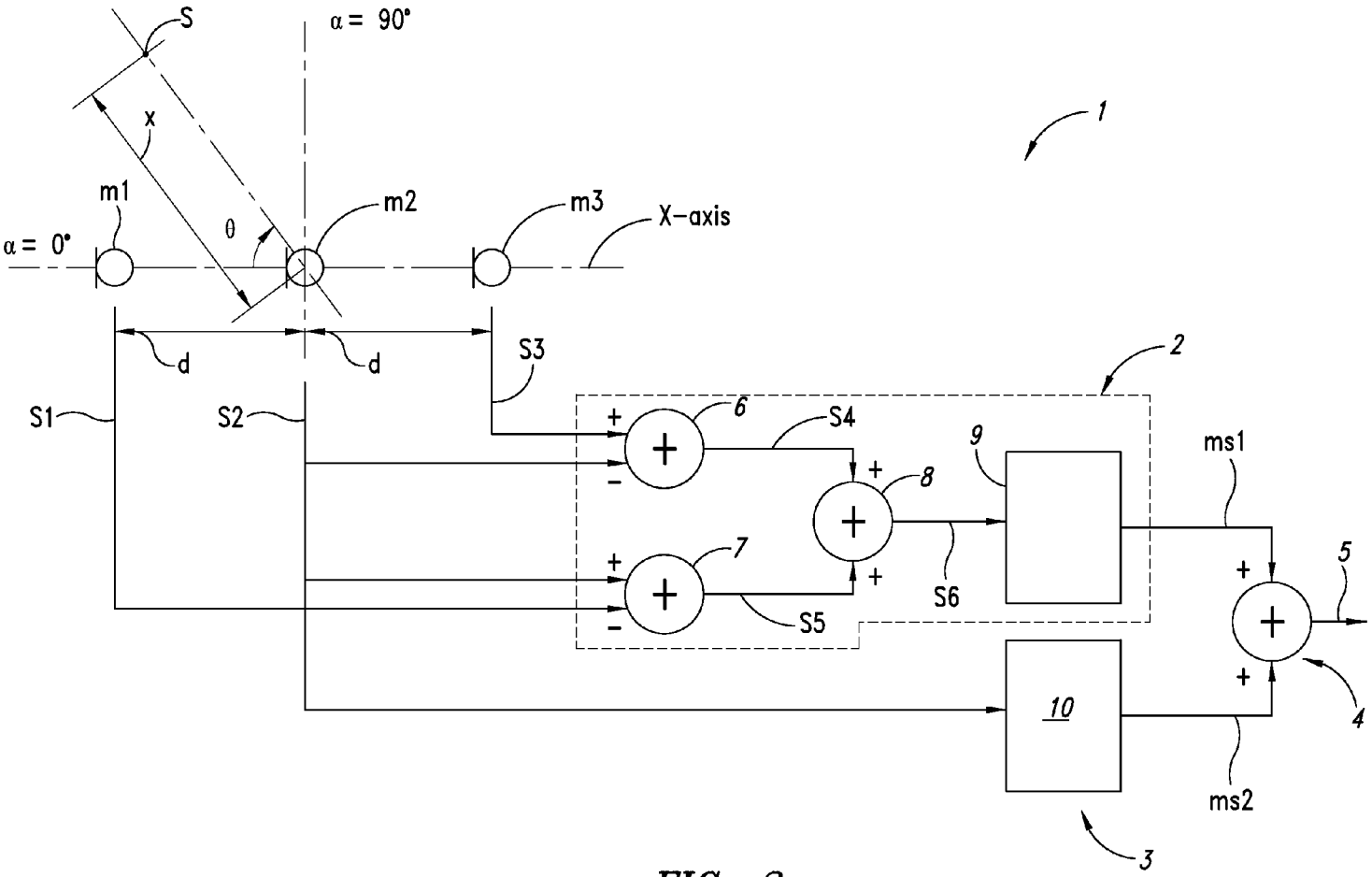
FIG. 3 shows an array microphone apparatus according to an embodiment.

As exemplified in FIG. 3, the microphone interposed between the other two microphones is the omni-directional directional microphone indicated with m2.

In other words, the three omni-directional microphones m1, m2 and m3 are arranged in horizontal coplanar alignment along the x-axis, and the omni-directional directional microphone m2 is disposed in the middle between the omni-directional directional microphones m1 and m3.

The audio signal received by the omni-directional microphones m1, m2 and m3 is emitted by a sound source S. θ is the phase angle of the sound source S with respect to the microphone arranged in the middle of the array of microphones m1, m2 and m3.

In the embodiment of FIG. 3, the microphone m1 is disposed on the left of the microphone m2, and microphone m3 is disposed on the right of the microphone m2.

Figure 5:
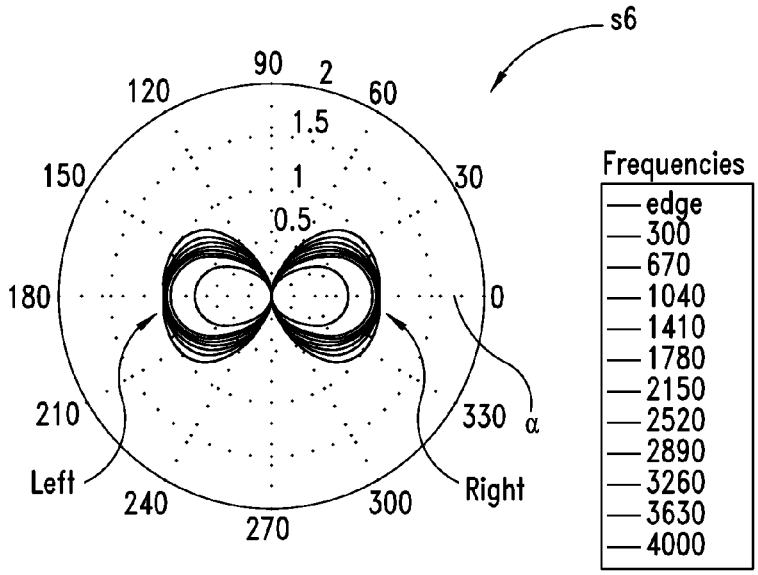
FIG. 5 shows a bi-directional pattern of the virtual channel.

The directional microphone forming device 2 receives the first, the second, and the third electrical signals s1, s2 and s3 to make the first, second and third omni-directional microphones m1, m2 and m3 jointly output a directional microphone signal ms1 with a bi-directional pattern (FIG. 5).

The directional microphone forming device 2 realizes a path (also defined as virtual channel) of the apparatus 1 able to generate the first directional microphone signal ms1 having the pattern that works in the opposite way of broad side beam forming.

In other words such directional microphone signal ms1 has a pattern similar to the pattern of an end fire beam forming.

In fact, also referring to FIG. 5, the first bi-directional pattern comprises two lobes in a first line α, i.e., the x-axis, the two lobes thereof respectively pointing to the left and right in the first line α.

The magnitude and phase response handler device 3 receives the electrical signal output by the omni-directional microphone m2 disposed between the other two omni-directional microphones m1, m3, i.e., it receives the electrical signal s2 output by the omni-directional microphone m2 arranged in the middle of the array of microphones m1 and m3.

The magnitude and phase response handler device 3 realizes a second path (or omni-directional channel) of the apparatus 1 able to generate the microphone signal ms2 having its pattern that works in the same way as an omni-directional microphone but shifted by an angle 180° with respect to the first pattern of the first directional microphone signal ms1.

In addition the magnitude and phase response handler device 3 adjusts the magnitude of signal ms2 to match the amplitude of the first directional microphone signal ms1 considering the left or right direction of sound arrival.

The omni-directional channel is represented therefore by the omni-directional microphone m2, i.e., the one arranged in the middle of the array of microphones m1, m2 and m3.

The combining device 4 receives the directional microphone signals ms1 and ms2 and outputs a combined directional microphone signal 5 with a combined beam pattern correlated to the bi-directional pattern ms1 and the omni-directional pattern ms2.

The combined directional microphone signal 5 is a signal having a broadside configuration.

Therefore, the apparatus 1 is able:

to generate, through the virtual channel or first directional microphone forming device 2, the first directional microphone signals ms1 that works in the opposite way of a classical broad side beam forming;

to generate, through the omni-directional channel or the magnitude and phase response handler device 3, a signal ms2 with an omni-directional pattern but in the time domain, the signal ms2 is 180° shifted with respect to the ms1. In terms of amplitude, the magnitude and phase response handler device 3 has also the task to adjust the amplitude of ms2 in order to match the amplitude of ms1 considering the angle θ=0 or 180;

to add, through the combining device 4, the first and second directional microphone signals ms1 and ms2.

Preferably, the prefixed phase angle θ is equal to 180° and hence, the apparatus 1 is able to reduce the sound coming from the directions beside the array m1, m2, and m3, and conversely able to keep the sound coming for example from the front of the array m1, m2, and m3.

In other words combining the first and second directional microphone signals ms1 and ms2 will ensure a deletion of the sound when coming from θ=0° and θ=180° and unchanged sound when coming from θ=90° and θ=270°.

To this end, the first directional microphone forming device 2 includes a first, a second, and a third adder 6, 7, and 8.

The first adder 6 receives:

the electrical signal s2 output by the omni-directional microphone m2 disposed between the other two omni-directional microphones m1 and m3; and the third electrical signal s3.

The first adder 6 is configured to output a first elaborated signal s4 as the difference between the third electrical signal s3 and the electrical signal s2 output by the omni-directional microphone m2.

The second adder 7 receives:

the electrical signal s2 output by the omni-directional microphone m2 disposed between the other two omni-directional microphones m1 and m3; and the first electrical signal s1.

The second adder 7 is configured to output a second elaborated signal s5 as the difference between the first electrical signal s1 and the electrical signal s2 output by the omni-directional microphone m2.

The third adder 8 receives the first and second elaborated signals s4 and s5, and the third adder 8 is configured to output a combined signal s6 sum of the first and second elaborated signals s4 and s5.

The first directional microphone forming device 2 includes a first equalization filter 9 that receives the combined signal s6. The equalization filter 9 is configured to output the first directional microphone signal ms1.

The first equalization filter 9 is configured for adjusting the magnitude and phase of the combined signal s6, as hereinafter described in detail.

The magnitude and phase response handler device 3 includes a second equalization filter 10 receiving the electrical signal s2, output by the omni-directional microphone m2 disposed between the other two omni-directional microphones m1, m3.

The second filtering device 10 is configured to adjust the magnitude and the phase of the electrical signal s2 output by the omni-directional microphone m2. The second filtering device 10 is configured to output the signal ms2.

The combining device 4 includes a fourth adder receiving the first and second directional microphone signals ms1 and ms2. The combining device 4 outputs the combined directional microphone signal 5.

The convenient combination of signals ms1 and ms2, with opportune adjusting of magnitude and phase through the first and second filtering devices 9 and 10, gives as a result a beam 5 formed in a broad side configuration.

In an embodiment, the first equalization filter 9 and the second equalization filter 10 are implemented with infinite impulse response (IIR) filters.

Figure 9:
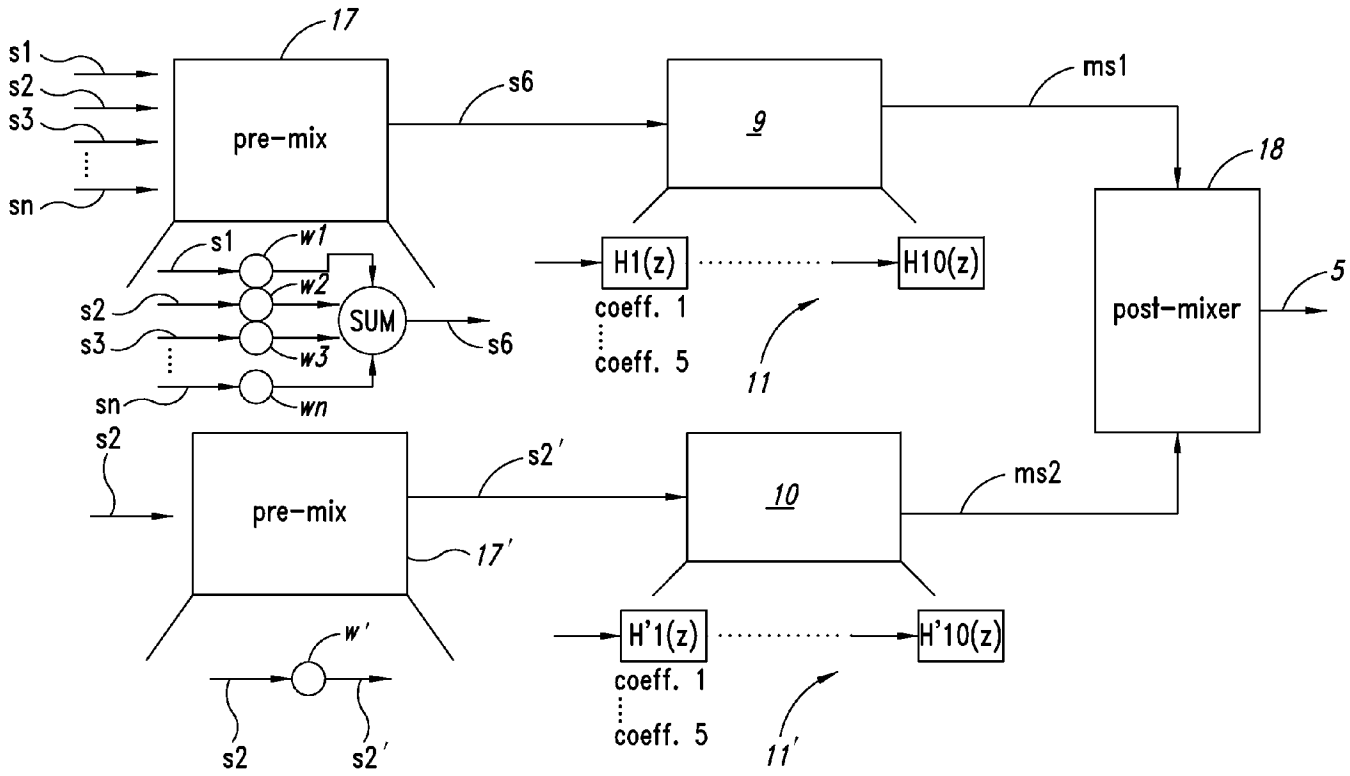
FIG. 9 is schematic block of an embodiment of the array microphone apparatus.

Referring now to FIG. 9, in which a possible implementing embodiment of the apparatus 1 is shown, the adders 6, 7, 8 and 4 can be physically implemented by the pre-mixers 17, 17' and post-mixer 18, respectively, whereas the first and second equalization filters 9 and 10 can be physically implemented by a chain 11, 11' of ten biquads.

Each pre-mixer 17, 17' is a digital block able to implement each of the output channels s2, s6 (at least two) of the apparatus 1.

Each pre-mixer 17, 17' works through an appropriate weighted (indicated as w1, . . . , wn for the pre-mixer 17, and w1', . . . , wn' for the pre-mixer 17') sum of the various inputs s1, s2, and s3 that are connected to the microphones m1, m2 and m3.

The same implementation can be applied for the post-mixer 18.

As depicted in FIG. 9, signal s2 can be weighted with its own weight (i.e., the weight indicated with w2') in order to match the phase response of the virtual channel in the bode diagram.

The pre and post mixer stages 17, 17' and 18, embedded in the apparatus 1, permit the possibility to combine the signals s1, s2, and s3 in every way.

Moreover in the case the number "n" of microphones displaced in the apparatus 1 is greater than three and/or another arrangement has provided for the "n" signals emitted by the "n" microphones, each pre-mixer stage 17, 17' can receive all the "n" signals and such "n" signals can be weighted and/or combined by specific weights w and summers.

Such solution gives flexibility to the user to set up his own beam former.

It is to be noted also that each biquad of the chains 11, 11' is a digital block able to implement a transfer function H(z), H(z)' in the digital domain.

The frequency response of the biquads of the chains 11, 11' depends on the value of the five coefficients coeff1, . . . , coeff5.

In other words the first and second equalization filters 9 and 10 are implemented as a random access memory (RAM) bank hosting the coefficients coeff1, . . . , coeff5 (five grouped) for custom frequency equalization. Since the biquads implement IIR filters, the frequency equalization modifies the response of the signals s2 and s6 in terms of magnitude but also introduce a phase distortion.

Particularly the IIR filtering stage, i.e., the first and second equalization filters 9 and 10, are configured to manage all the parameters such as magnitude and phase of signals s2 and s6.

The eventually required delays are managed by taking advances from the phase distortion introduced from the IIR filters.

In the following are described a way to generate signals ms1, ms2, and the combined directional microphone signal 5.

Signal ms1

Assuming that (FIG. 3):

- the distance x of the sound source S from the microphones in the array m1, m2 and m3 is much bigger than the distance d between the microphones m1, m2 and m3, that is x>>d, and
- the microphones in the array m1, m2 and m3 are in horizontal coplanar alignment, and
- the microphone m2 is between the other two microphones m1 and m3, being m1 on the left and m3 on the right, then the distances of each of the microphones m1, m2 and m3 from the sound source S can be respectively represented as follows:

m2: $X_2=x\ \nabla\phi$ m3: $X_3=x+d\cdot\cos(\phi)0<\phi<90$ m1: $X_1=x-d\cdot\cos(\phi)0<\phi<90$ For example considering the direction θ=0° the distances of each microphones m1, m2 and m3 from the sound source S can be respectively represented as follows:

m2: $X_2=x$ m3: $X_3=x+d$ m1: $X_1=x-d$

Considering also the next variables:

$S_m$: the microphone sensitivity;

$$K=\frac{2\pi\cdot f}{c}:$$

the acoustic wave number;

f and c are respectively the considered wave frequency and the sound speed

The response of each microphone m1, m2 and m3 can be respectively represented by the next equations:

$$m2:\ R_{m2}(x)=S_2\cdot e^{(i\cdot K\cdot X_2)}=S_2\cdot e^{\left(\frac{i\cdot 2\pi\cdot f\cdot x}{c}\right)}$$

$$m3:\ R_{m3}(x)=S_3\cdot e^{(i\cdot K\cdot X_3)}=S_3\cdot e^{\left(\frac{i\cdot 2\pi\cdot f\cdot(x+d\cdot\cos(\phi))}{c}\right)}$$

$$m1:\ R_{m1}(x)=S_1\cdot e^{(i\cdot K\cdot X_1)}=S_1\cdot e^{\left(\frac{i\cdot 2\pi\cdot f\cdot(x-d\cdot\cos(\phi))}{c}\right)}$$

Once the microphone's responses $R_{m1}$, $R_{m2}$ and $R_{m3}$ have been calculated for each microphone m1, m2 and m3, it is possible to define the response of the microphone array.

In fact, the electrical signals s2 and s3 are routed to the adder 6, and the electrical signals s1 and s3 are routed to the adder 7 in order to perform the following sums:

Adder 6=$R_{m3}-R_{m2}$, i.e., the signal s4,

Adder 7=$R_{m1}-R_{m2}$, i.e., the signal s5,

The adder 8 makes the sum of the previous results. The mathematical sum is equal to the next difference:

Adder 8=$R_{m1}+R_{m3}-2\cdot R_{m2}$, i.e., the signal s6

From an acoustical point of view, the previous mathematical operation (Adder 8 result, i.e., the signal s6) means that the sound coming from direction θ=90° is completely deleted, since cos(90)=0 and the microphones sensitivities are the same:

$$R_{m1}+R_{m3}-2\cdot R_{m2}=S_1\cdot e^{\left(\frac{i\cdot 2\pi\cdot f\cdot x)}{c}\right)}+S_3\cdot e^{\left(\frac{i\cdot 2\pi\cdot f\cdot x}{c}\right)}-2\cdot S_2\cdot e^{\left(\frac{i\cdot 2\pi\cdot f\cdot x}{c}\right)}=0$$

The sound coming from the θ=0° direction has a frequency response depending from the distance d with respect to the frequency of the coming sound, since cos(0)=1:

$$R_{m1}+R_{m3}-2\cdot R_{m2}=S_1\cdot e^{\left(\frac{i\cdot 2\pi\cdot f\cdot (x-d)}{c}\right)}+S_3\cdot e^{\left(\frac{i\cdot 2\pi\cdot f\cdot (x+d)}{c}\right)}-2\cdot S_2\cdot e^{\left(\frac{i\cdot 2\pi\cdot f\cdot x}{c}\right)}$$

Figure 4:
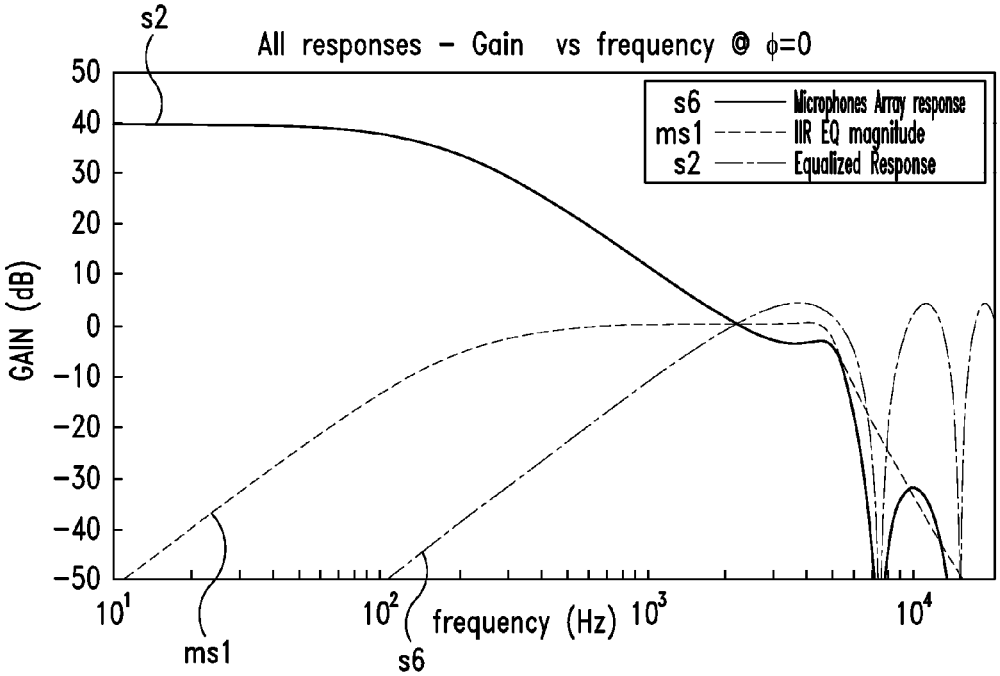
FIG. 4 shows the overall responses of a virtual channel defined in the array microphone apparatus of FIG. 3.

The frequency response of the signal s6, varying the f parameter in the previous equation, is represented in the FIG. 4. The frequency response of the signal s6 looks like a high pass filter with fixed order.

The first equalization filter 9 applies frequency equalization 12 in order to compensate the microphone array response $R_{m1}$, $R_{m2}$ and $R_{m3}$. As a result, i.e., the first directional microphone signal ms1, it is possible to achieve a flat response in the desired bandwidth.

The overall response, i.e., the first directional microphone signal ms1, considering a sound coming from θ=0° direction is represented by FIG. 5.

The choice of three microphones m1, m2 and m3 combined as represented in FIG. 3 has not only been done to generate the eight figures of the FIG. 5 polar diagram but also because it is able to achieve the same phase shift between the adder 8 result and the omni-directional microphone, i.e., the omni-directional microphone signal ms2.

In fact, considering the result of one adder only, for example adder 6, if the sound comes from direction θ=0°, the waves kept by the microphones m3-m2 have a fixed phase shift θ with respect to the omni-directional microphone (i.e., m2 only). If the sound comes from θ=180° direction, the phase shift is equal to the previous one plus θ=180°.

Thanks to the described above apparatus, the combination of the two adders 6 and 7, it is possible to provide the same phase shift between the adder 8 result, i.e., the signal s6 and the omni-directional microphone, i.e., the signal s2.

Signal ms2

The ms2 signal is preferably set 180° shifted with respect to the ms1 signal. This goal is reached applying through the second equalization filters 10 an equalization that looks like the equalization applied by the first equalization filters 9 but in terms of phase response only.

Finally a gain may also be applied in order to match the microphones signal amplitude ms1 and ms2 when the sound comes from θ=0° or 180° direction.

Figure 6A:
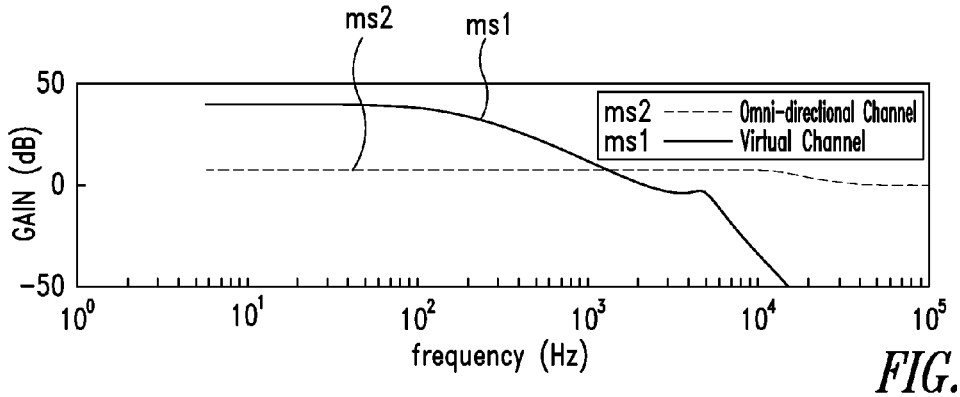
FIG. 6 is a graph illustrating frequency vs. gain and frequency vs. phase when the equalization is applied to the virtual channel and to the omni-directional channel.
Figure 6B:
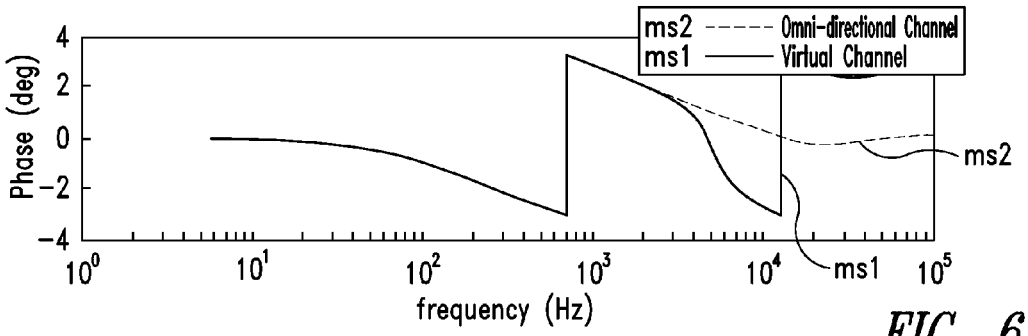

The equalizations applied by the first and second equalization filters 9 and 10 are represented in FIGS. 6A and 6B.

The choice of these first and second equalization filters 9 and 10 can be made considering:

- the magnitude; it is done to match the amplitude of the two channels (i.e., the omni-directional channel and virtual channel);
- the phase; it is done to ensure a fixed θ=180° between the two channels (i.e., the omni-directional channel and virtual channel).

The choice of the multiple adder stage 6, 7, and 8 may achieve this statement both for direction θ=0° and θ=180°; in other words both for left and right.

Combined Directional Microphone Signal 5

At this point, the directional microphone signal ms1 and the omni-directional signal ms2 are routed to the adder 4 and, if the sound comes from left or right, the two signals ms1 and ms2 have the same amplitude but 180° phase shifted; if the sound comes from the front direction, the virtual channel brings a very low amplitude wave while the omni-directional channel is unchanged.

Figure 7A:
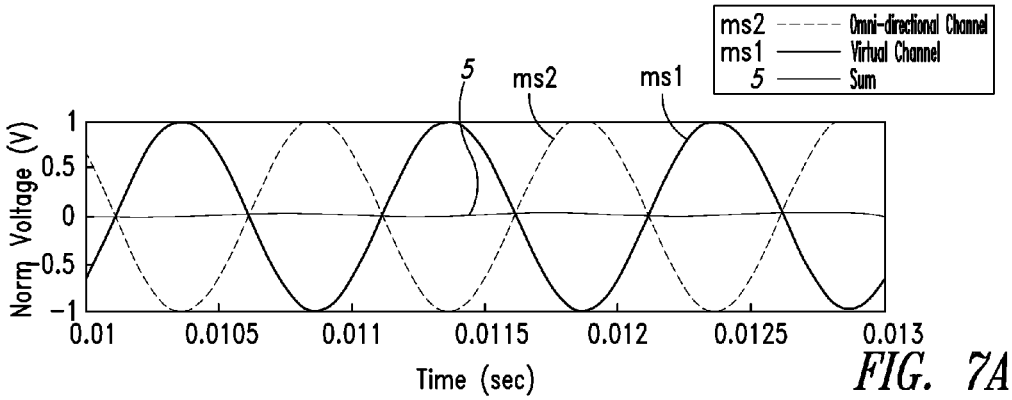
FIGS. 7A, 7B are graphs illustrating time vs. voltage of the overall response of the array microphone apparatus in the case the sound is coming from beside or front direction, respectively.
Figure 7B:
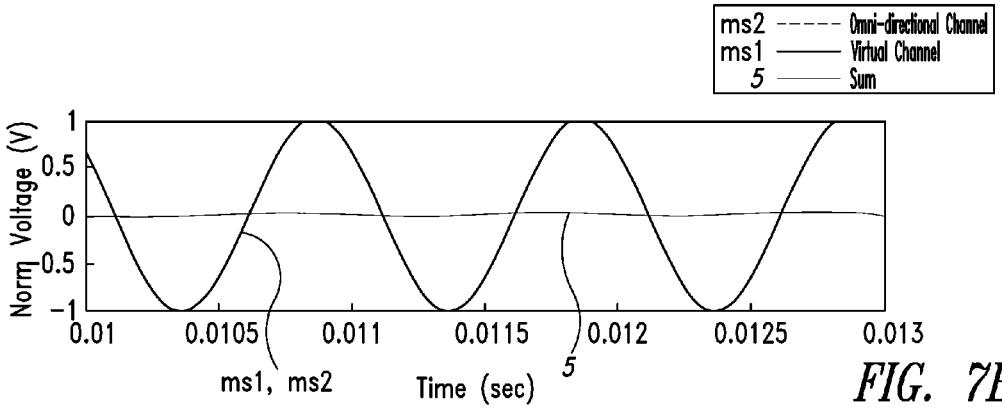

Adding such first and second signals ms1 and ms2 permits the apparatus 1 to return a deletion of the sound if coming from left or right (FIG. 7A). Alternatively, it returns the omni-directional signal if the sound is coming from the front direction (FIG. 7B).

Figure 8:
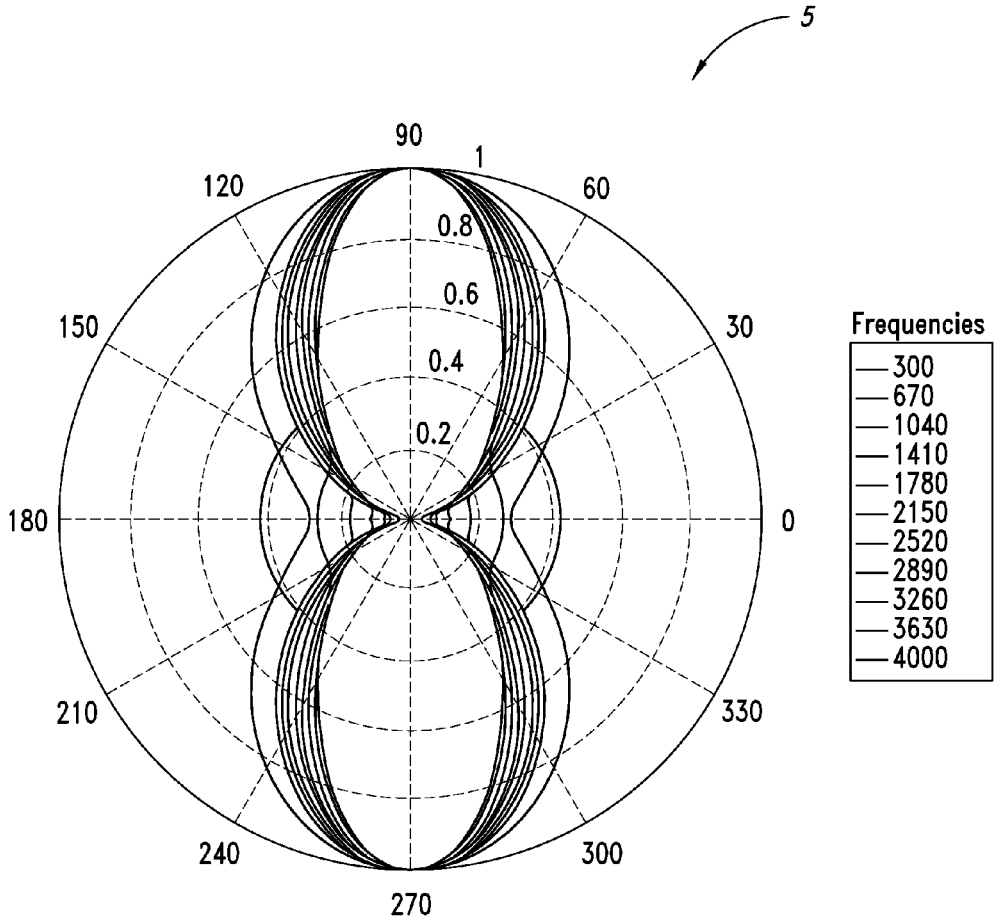
FIG. 8 shows a bi-directional pattern of the array microphone apparatus according to an embodiment.

The respective polar diagram of the overall system is depicted in FIG. 8.

Advantageously, the combination of the virtual channel with the omni-directional channel gives as a result the broad side configuration, i.e., the combined directional microphone signal 5, that works properly for all the bandwidth where the end fire is working and not only for a fixed frequency.

Of course, a man skilled in the art, in order to satisfy contingent and specific needs, can make numerous modifications and variations to the apparatus, according to the invention described above, all moreover contained in the protective scope of the invention as defined by the following claims.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An array microphone apparatus to generate a beam forming signal, the apparatus comprising:

first, second, and third omni-directional microphones to convert an audible signal into corresponding first, second, and third electrical signals, respectively, said first, second, and third omni-directional microphones arranged in a horizontal coplanar alignment, the second omni-directional microphone being disposed between the first and third omni-directional microphones;

a directional microphone forming device to receive the first, second, and third electrical signals and to produce a first directional microphone signal having a bi-directional pattern;

a magnitude and phase response handler device to receive the second electrical signal and to output a second directional microphone signal having an omni-directional pattern, the omni-directional pattern shifted by a prefixed value with respect to the bi-directional pattern of the first directional microphone signal; and a combining device to receive the first and second directional microphone signals and to output a combined directional microphone signal having a combined beam pattern correlated to the bi-directional pattern of the first directional microphone signal and to the omni-directional pattern of the second directional microphone signal, the combined directional microphone signal being perpendicular to the horizontal coplanar alignment of the first, second, and third omni-directional microphones.

2. An array microphone apparatus according to claim 1 wherein said prefixed value is 180°.

3. An array microphone apparatus according to claim 1 wherein the bi-directional pattern of the first directional microphone signal has two lobes in a first line, the two lobes thereof respectively pointing to the left and right in the first line, and the omni-directional pattern of the second directional microphone signal has two lobes in a second line substantially perpendicular to the first line, the two lobes thereof respectively pointing to the left and right in the second line.

4. An array microphone apparatus according to claim 1 wherein said directional microphone forming device comprises:

a first, a second, and a third adder, wherein:

said first adder is configured to receive the second electrical signal and the third electrical signal and to output a first elaborated signal as a difference between the third electrical signal and the second electrical signal, said second adder is configured to receive the second electrical signal and the first electrical signal and to output a second elaborated signal as a difference between the first electrical signal and the second electrical signal, and said third adder is configured to receive said first and second elaborated signals and to output a combined signal as a sum of said first and second elaborated signals.

5. An array microphone apparatus according to claim 4 wherein said directional microphone forming device comprises:

a first equalization filter to receive said combined signal, said first equalization filter configured to adjust a magnitude and a phase of said combined signal and to output said first directional microphone signal.

6. An array microphone apparatus according to claim 5 wherein said magnitude and phase response handler device comprises:

a second equalization filter to receive said second electrical signal, said second equalization filter configured to adjust the magnitude and the phase of said second electrical signal and to output said second directional microphone signal.

7. An array microphone apparatus according to claim 5 wherein said combining device comprises:

a fourth adder to receive the first directional microphone signal with the bi-directional pattern and the second directional microphone signal with the omni-directional pattern, the fourth adder configured to output said combined directional microphone signal.

8. An array microphone apparatus according to claim 5 wherein said first and second equalization filters are implemented with infinite impulse response (IIR) filters.

9. A beam forming method, comprising:

arranging a first, second, and third omni-directional microphones in horizontal coplanar alignment to convert an audible signal into corresponding first, second, and third electrical signals, respectively, wherein the second omni-directional microphone is disposed between the first and third omni-directional microphones;

jointly outputting, from the first, second, and third omni-directional microphones, a first directional microphone signal having a bi-directional pattern;

outputting, from the second omni-directional microphone, a second directional microphone signal having an omni-directional pattern;

shifting by a prefixed angle said second directional microphone signal with respect to said first directional microphone signal; and combining the first directional microphone signal having the bi-directional pattern and the second directional microphone signal having the omni-directional pattern to generate a combined directional microphone signal having a combined beam pattern correlated to the bi-directional pattern of the first directional microphone signal and to the omni-directional pattern of the second directional microphone signal, the combined directional microphone signal being perpendicular to the horizontal coplanar alignment of the first, second, and third omni-directional microphones.

10. A beam forming method according to claim 9 wherein forming the first directional microphone signal having the bi-directional pattern includes forming the bi-directional pattern with two lobes in a first line, the two lobes thereof respectively pointing to the left and right in the first line, and forming the second directional microphone signal having the omni-directional pattern includes forming the omni-directional pattern with two lobes in a second line substantially perpendicular to the first line, the two lobes thereof respectively pointing to the left and right in the second line.

* * * * *